United States Patent [19]

Harrison

[11] Patent Number: 5,076,255

[45] Date of Patent: Dec. 31, 1991

[54] BARRIER FOR APPLIANCES AND THE LIKE

[76] Inventor: Bradford L. Harrison, 3228 E. Holland Ave., Fresno, Calif. 93726

[21] Appl. No.: 461,374

[22] Filed: Jan. 5, 1990

[51] Int. Cl.[5] ..... F24C 3/12

[52] U.S. Cl. ..... 126/42; 126/22; 126/211; 126/214 D

[58] Field of Search ..... 126/211, 214 R, 214 D, 126/42, 35, 22

[56] References Cited

U.S. PATENT DOCUMENTS

| | | | |
|---|---|---|---|
| 801,690 | 10/1905 | Rails | 126/201 |
| 970,010 | 12/1908 | Davidson | 126/201 |
| 2,656,780 | 10/1953 | Spieth | 237/79 X |
| 2,699,162 | 1/1950 | Nazzaro . | |
| 2,707,620 | 5/1955 | Snyder | 237/79 |
| 2,778,356 | 1/1957 | Pugach . | |
| 3,513,826 | 5/1970 | Hellmuth . | |
| 4,155,343 | 5/1979 | Hartman . | |
| 4,157,705 | 6/1979 | Caan . | |
| 4,314,543 | 2/1982 | Bullington et al. | 126/201 |
| 4,517,955 | 5/1985 | Ehrlich et al. . | |
| 4,527,540 | 7/1985 | Ryan et al. | 126/201 X |
| 4,836,181 | 6/1989 | Saga | 126/211 X |

FOREIGN PATENT DOCUMENTS

| | | |
|---|---|---|
| 2608638 | 9/1977 | Fed. Rep. of Germany . |
| 70933 | 9/1946 | Norway . |
| 168696 | 9/1959 | Sweden . |
| 942382 | 11/1963 | United Kingdom . |

*Primary Examiner*—Larry Jones

*Attorney, Agent, or Firm*—Worrel & Worrel

[57] ABSTRACT

A barrier for appliances and the like having a substantially rigid panel, a mount adapted to be secured in fixed relation to the appliance and fasteners for securing the panel on the mount to proscribe a protected zone relative to the appliance.

4 Claims, 4 Drawing Sheets

BARRIER FOR APPLIANCES AND THE LIKE

BACKGROUND OF THE INVENTION

1. Field of the Invention

The present invention relates to a barrier for appliances and the like and more particularly to such a barrier which is principally adapted to protect children from injury by contact with the heated surfaces of appliances such as cooking ranges, wood burning stoves, and a variety of other appliances which cannot, as a practical matter, be monitored at all times when in operation or when otherwise hot and therefore are accessible to small children.

2. Description of the Prior Art

The protection of small children from inadvertent injury by contact with the heated surfaces of cooking ranges, stoves and the like has long been a concern of parents and other responsible adults. Unfortunately, this concern has not resulted in the development of a practical solution to the problem although a multitude of prior art efforts have focused on developing just such a solution. The problem is particularly acute in the case of cooking ranges, not only due to the presence of hot electrical or gas burners on the upper surfaces of the ranges, but also because of the presence of cooking utensils such as pots or pans left unattended on the burners and containing very hot substances and, in particular, very hot or boiling fluids. The handles of such utensils constitute an attraction to young children and may be within their grasp with or without the use of a stool, chair or other readily available object. The hazard of children pulling such substances onto them resulting in severe injury or even death is a concern not heretofore met in a satisfactory fashion by prior art devices.

Such prior art devices are characterized by a variety of walls, shields, and the like which attach to the appliances to form a shield against the natural curiosity exhibited by small children. Unfortunately, such devices themselves become heated by the proximity to the heating surfaces and therefore become a hazard to children which is even more accessible. Such prior art efforts are additionally characterized by complex methods for installation. These include the use of adhesives, which can deteriorate in the presence of heat; magnets, which can be pulled loose from magnetic engagement by the hands of such children and therefore in themselves become hazardous; and devices which require being screwed or bolted on a range top which makes them not only inconvenient to install but leaves highly visible traces including bolt holes and mars which are unsightly when the device is removed, such as after the children have matured.

A similar hazard exists in the case of such appliances as wood burning stoves which have become particularly popular as an effective source of heat as well as for aesthetic reasons. One of the benefits of such heating devices is that all or substantially a portion of the exposed metal surfaces of such devices become heated to the point that they liberate heat energy into the room rapidly and efficiently. However, those same metal surfaces are exposed to inadvertent contact by children, adults and animals and serious injury resulting therefrom is known to occur. Conventional construction calls for such stoves to be mounted on a heat resistant surface and, where adjacent to a wall, to have a heat resistant surface covering the adjacent portions of the wall. Many fire codes require such construction, but no practical device has been developed to protect the occupants of the room from injury as a result of inadvertent contact with the stove.

Therefore, it has long been known that it would be desirable to have a barrier for appliances and the like which possesses a flexibility of use having application to virtually all types of such appliances and the like where such hazards are present; which can securely be attached in position on or near the appliances without complex or permanent damage to the appliances; which operates to insulate itself from becoming heated to a degree which would be injurious in contact therewith; which, in the case of appliances such as cooking ranges, operates to dissipate unwanted heat; and, which in the case of heating devices such as stoves operates to permit the transmission of the heat therethrough to adjacent areas for warmth.

SUMMARY OF THE INVENTION

Therefore, it is an object of the present invention to provide an improved barrier for appliances and the like having particular utility when employed on appliances such as cooking ranges, stoves and the like to protect small children and others from injury as a result of contact with the heat generating portions thereof.

Another object is to provide such a barrier which serves as a convenient and fully dependable method by which children can be protected from injuring themselves due to their natural curiosity by grabbing or otherwise contacting the electrical or gas burners of cooking ranges or by pulling utensils containing heated substances off onto themselves.

Another object is to provide such a barrier which can be installed on and removed from the appliance or positioned relative thereto without leaving any evidence of ever having been present so as not to detract from the aesthetic appearance thereof.

Another object is to provide such a barrier which operates to insulate itself from becoming heated to such an extent as to cause a hazard by tactile contact.

Another object is to provide such a barrier which, when employed in an embodiment for use in association with heat generating devices such as stoves, operates to protect people from inadvertent contact with the heated surfaces of the device itself, but which permits the desired heat energy produced thereby to be transmitted therethrough to the occupants of the room for warmth.

Another object is to provide such a barrier which, in operation in an embodiment applicable to heat generating devices such as wood burning stoves, possesses the ability to provide access therethrough for tending the fire within the device.

Another object is to provide such a barrier which presents an aesthetically pleasing appearance fully compatible with the appliance itself and surrounding structures while not interfering in any way with the normal use of the appliance.

Further objects and advantages are to provide improved elements and arrangements thereof in an apparatus for the purposes described which is dependable, economical, durable and fully effective in accomplishing its intended purposes.

These and other objects advantages are achieved, in the device of the preferred embodiment of the present invention, having a substantially transparent, rigid panel having a first section and second sections diverging from the first section, a mount adapted to be secured in fixed relation to the appliance, and fastening devices for mounting the panel on the mount to proscribe a protected zone relative to the appliance.

DESCRIPTION OF THE PREFERRED EMBODIMENT

First Form

Figure 1:
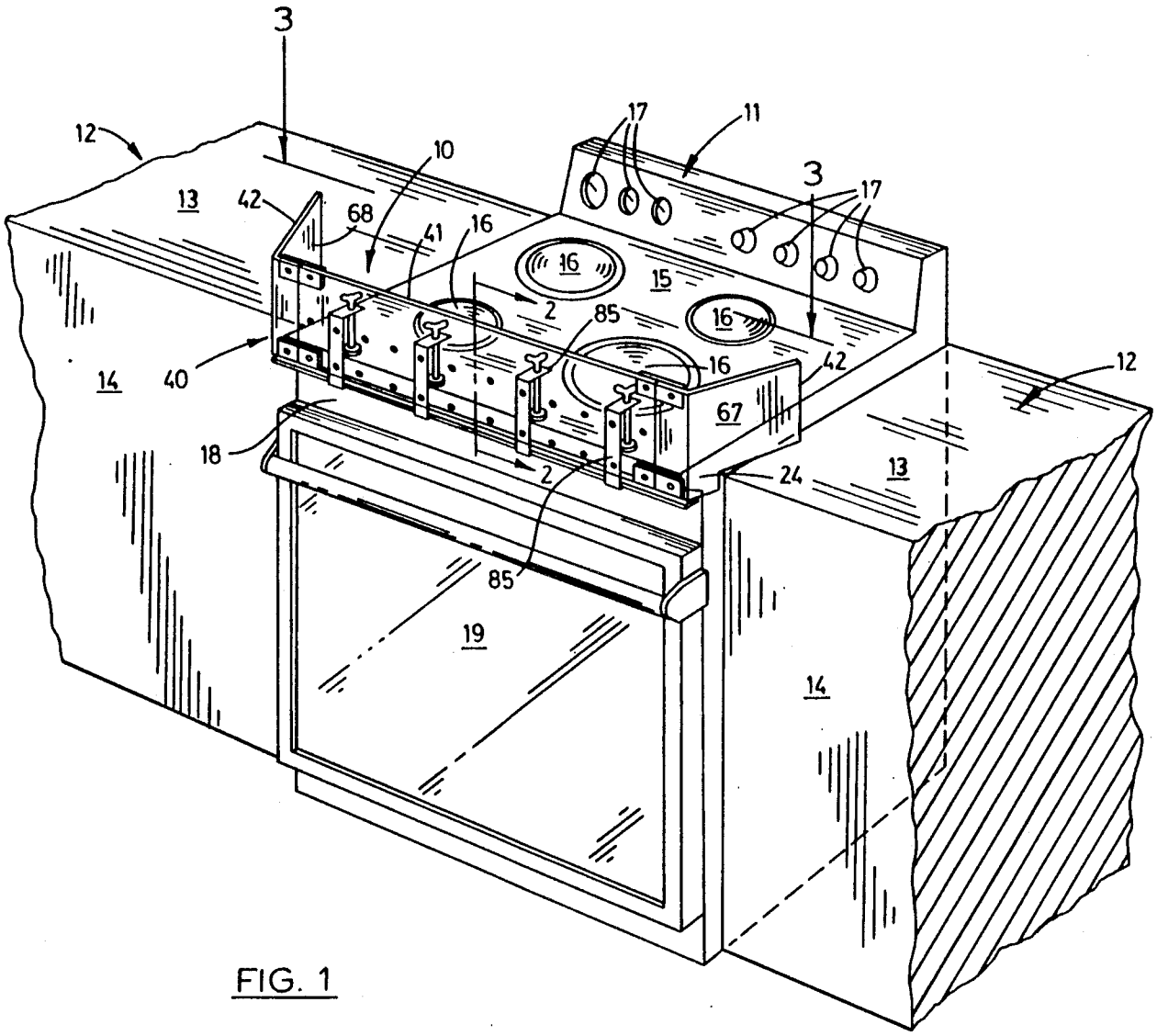
FIG. 1 is a fragmentary, perspective view of the first embodiment of the present invention mounted on an appliance in a typical operative environment.
Figure 3:
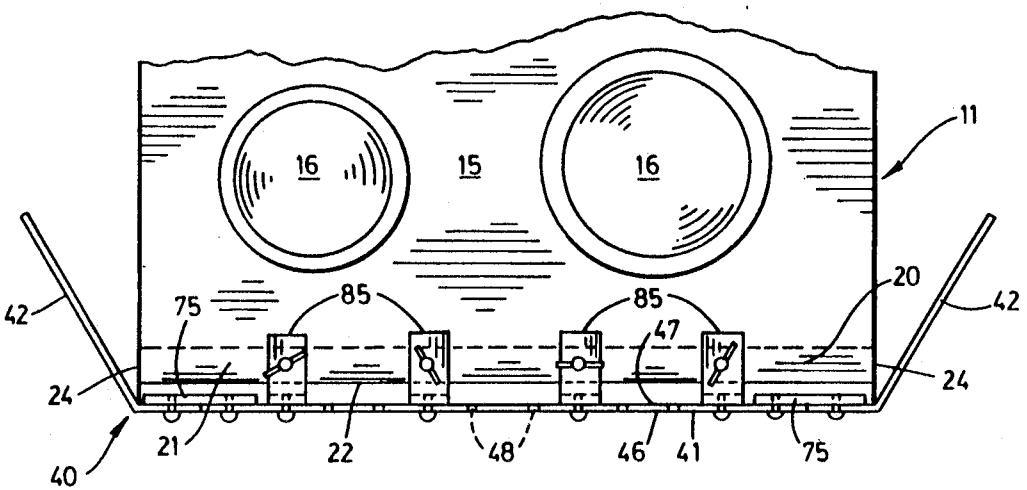
FIG. 3 is a somewhat enlarged, fragmentary, top plan view taken from the position indicated by line 3—3 in FIG. 1.

The barrier of the first form of the invention is shown in FIGS. 1, 2, 3, and 4 and is generally indicated by the numeral 10. The barrier is shown in FIG. 1 in a typical operative environment installed on a built-in or drop-in cooking range 11. For illustrative convenience, the cooking range is shown in an installed position between two counters 12. Also for illustrative convenience, the counters are shown in block form. It will be understood that the counters may be of any design. Each counter has an upper surface 13 and a front surface 14.

Referring more particularly to the cooking range 11, the cooking range has an upper or cooking surface 15 in which are mounted a plurality of burners 16. The cooking range has conventional controls 17 and a vertical front surface 18 in which is mounted an oven door 19 for providing access to the oven.

As is common in cooking ranges, the range 11 has a projecting portion 20 extending forwardly from the front surface 18 above the oven door 19. The projecting portion has an upper surface 21 which constitutes an extension of the cooking surface 15, a front surface 22, and a lower surface 23. The projecting portion, as is commonly the case, can be constructed in a variety of forms dependent in large part on the aesthetic preferences of the manufacturer. The barrier 10 does not depend for its operation on any particular configuration of projecting portion. The projecting portion has lateral sides 24.

The barrier 10 has a protective panel 40 composed of a substantially planar first section 41 and lateral or second sections 42. The protective panel is preferably, although not necessarily, constructed of a transparent plastic material such as plexiglass or the like. Where plastic is employed, a heat resistant plastic is preferred. The panel can, of course, be constructed of a variety of different materials including transparent and non-transparent materials. However, the transparent, heat resistant, plexiglass material is preferred for both aesthetic and practical reasons, as will hereinafter become more clearly apparent.

Figure 4:
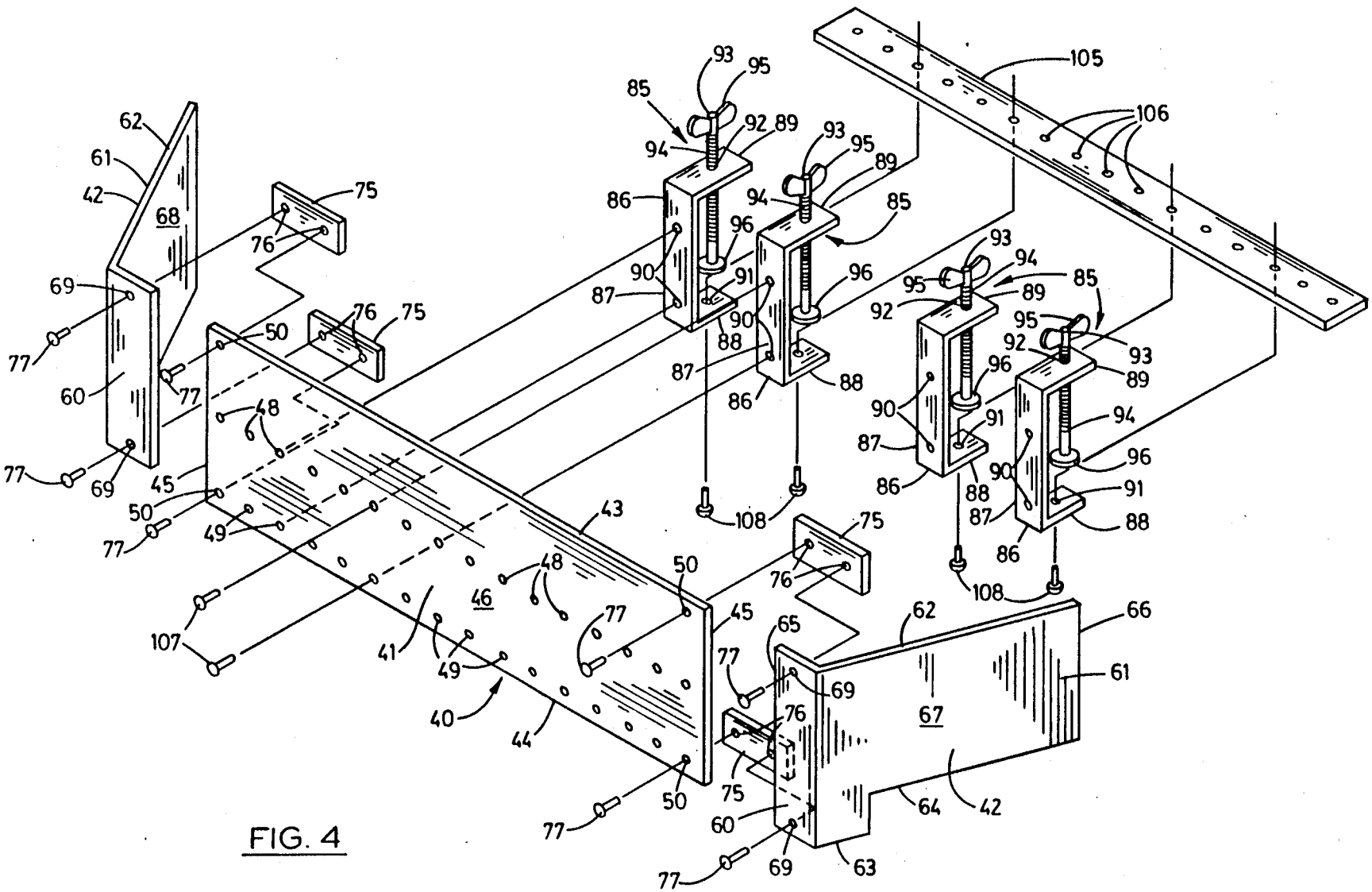
FIG. 4 is a somewhat enlarged, exploded perspective view of the first embodiment of the present invention.

The first section 41 is preferably rectangular in configuration having an upper edge 43, a substantially parallel lower edge 44, and substantially right angularly related lateral edges 45 extending therebetween. The first section has a forward surface 46 and an opposite, rearward surface 47. Screw holes 48 are formed in the first section substantially centrally thereof to form a row as can best be seen in FIG. 4. A plurality of screw holes 49 are extended through the first section 41 adjacent to the lower edge 44 thereof and forming a row, also as best shown in FIG. 4. Corner screw holes 50 are individually extended through the first section adjacent the corners thereof.

Each second section 42 includes a mounting portion 60 and an oblique portion 61 in the preferred embodiment. As will hereinafter be set forth in greater detail, the particular size, type and installed relationship of the cooking range 11 controls the specific configuration which is best suited for the protective panel 40. As can be seen in FIG. 1, the particular configuration herein described for the preferred embodiment of the first form of the present invention is particularly adapted for the operative environment shown in FIG. 1.

Each second section 42 has an upper edge 62, and a lower edge 63. The oblique portion of the lower edge 63 has a notched or recess portion 64 which is specifically configured for the operative relationship shown in FIG. 1. Each second section has a proximal lateral edge 65 and an opposite distal lateral edge 66 substantially parallel thereto. The second section has a forward surface 67 and an opposite rearward surface 68. A pair of screw holes extend through the mounting portion 60 of each second section 42.

Each second section 42 is mounted on the first section 41 employing a pair of mounting plates 75. The mounting plates can be constructed of metal or may themselves be transparent. Each of the mounting plates has a pair of screw threaded bores 76. Each second section is mounted on its respective end of the first section with the screw threaded bores 76 of the mounting plate 75 individually aligned with the screw holes 69 and 50 of the second section and first section respectively and the screws 77 individually screw-threadably secured in the screw threaded bores 76 thereof as can best be visualized in FIG. 4. The resulting construction is such that the protective panel forms a unitary, transparent barrier having a substantially flat first section and oppositely obliquely extending second sections 42.

Figure 2:
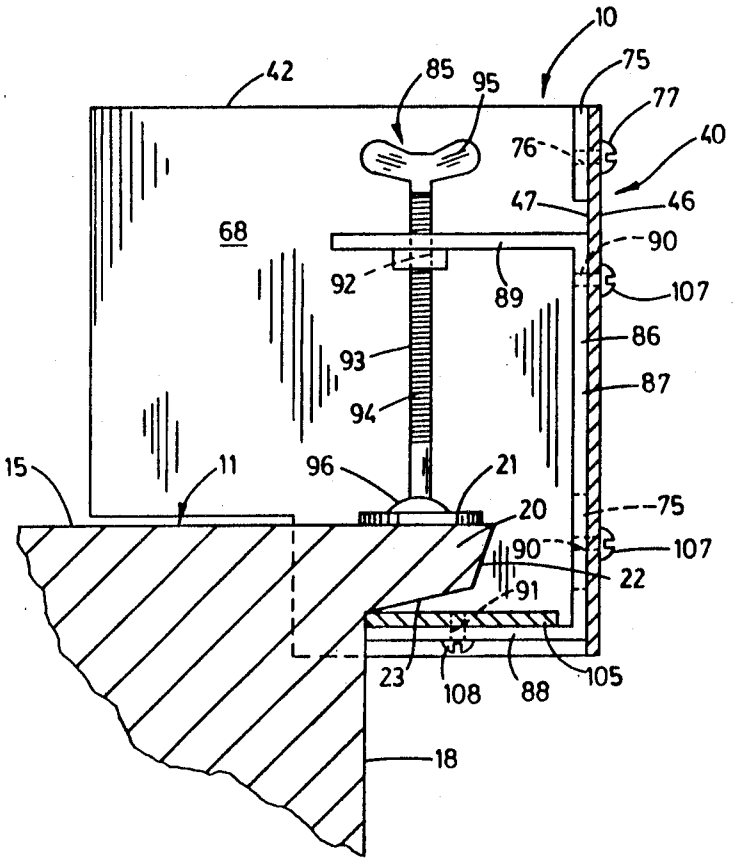
FIG. 2 is a somewhat enlarged, fragmentary, transverse, vertical section taken on line 2—2 in FIG. 1.

As shown best in FIGS. 2 and 4, the barrier 10 has four clamp assemblies 85. Depending upon the size and requirements of the specific environment in which the barrier 10 is to be employed, fewer or more of the clamp assemblies 85 can be employed. Each clamp assembly has a frame 86 consisting of a substantially flat back portion 87, a right-angularly related base portion 88 and a mounting portion 89 integral with the back portion and extending in spaced, substantially parallel relation to the base portion 88. The back portion of each frame 86 has a pair of screw threaded bores 90 extending therethrough. The base portion of each frame has a screw hole 91. The mounting portion of each frame has a screw threaded bore 92 which, as can best be seen in FIG. 2, can be established by welding a nut onto the mounting portion in alignment with the screw threaded bore 92.

Each clamp assembly 85 has a securing member 93 consisting of a screw threaded shaft 94 having a handle 95 at one end thereof and a swivel foot 96 at the opposite end thereof. As can best be visualized in FIG. 2, the securing member is screw-threadably received in the screw threaded bore 92 for adjustment of the swivel foot 96 toward and from the base portion 88 using the handle 95.

The barrier 10 has a lower protective panel 105 which is also preferably constructed of transparent, heat resistant plexiglass. The lower protective panel 95 has a plurality of screw threaded bores 106 extending therethrough as can best be seen in FIG. 4. The protective panel 40 is mounted on the clamp assemblies 85 by extension of screws 107 through the screw holes 48 and 49 of the first section 41 and into the screw threaded bores 90 and tightened into position to mount the protective panel thereon. Screws 108 are extended through the screw holes 91 of the base portions 88 of the frames 86 and screw-threadably secured in the screw threaded bores 106 of the lower protective panel 105 mounted in the position shown best in FIGS. 2 and 4.

Second Form

Figure 5:
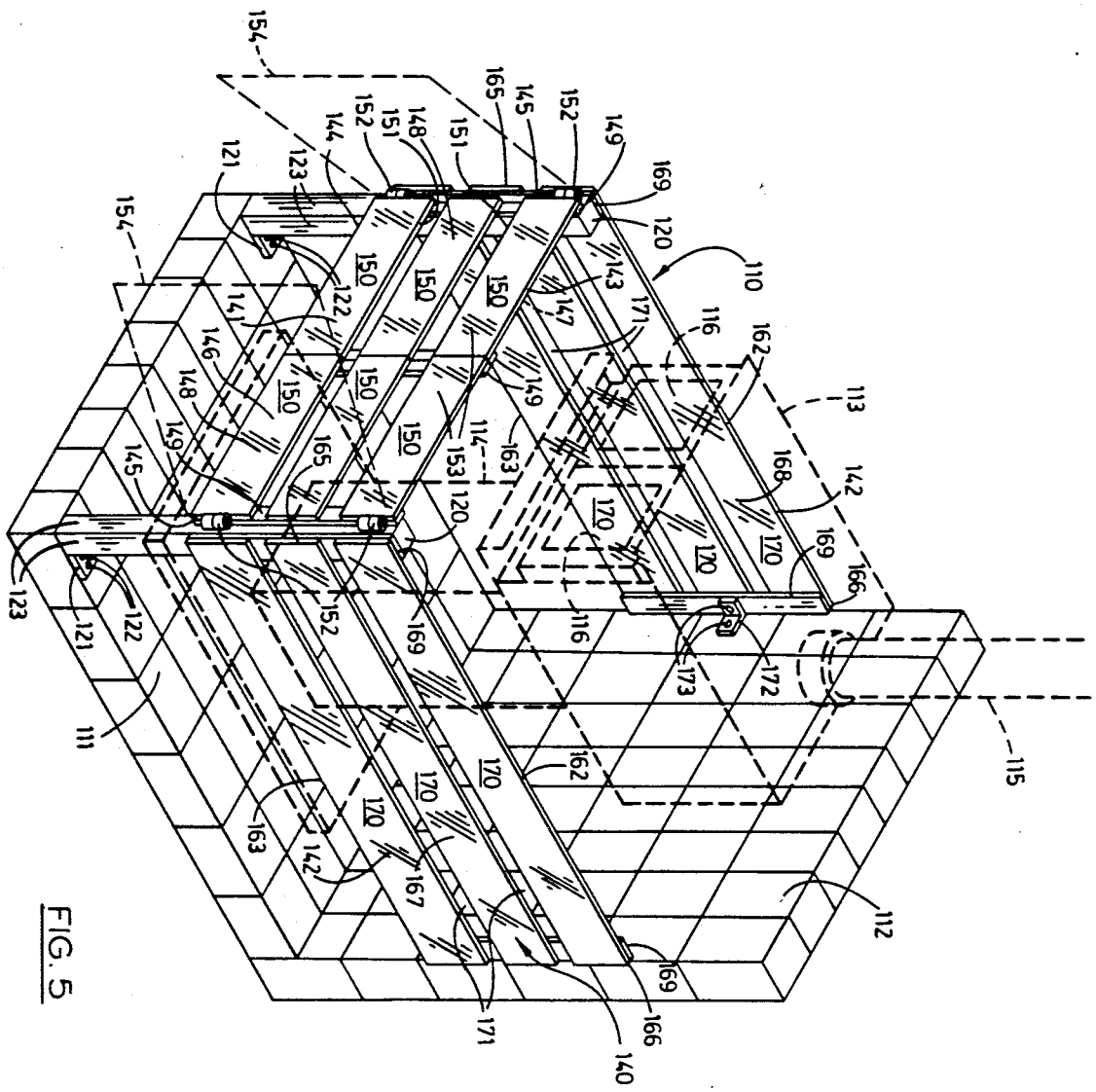
FIG. 5 is a perspective view showing the second embodiment of the apparatus of the present invention in a typical operative environment in protective relation to a wood burning stove which is shown in phantom lines and, additionally, showing door sections of the first panel of the present invention in phantom lines in an opened position and in full lines in closed position.

The barrier of the second form of the present invention is generally indicated by the numeral 110 and is shown in FIG. 5. The barrier 110 is shown in FIG. 5 in a typical operative environment wherein a horizontal, heat resistant surface 111 joins a vertical heat resistant surface 112. It will be understood that the heat resistant surface 111 is mounted on a floor, not shown, and the vertical heat resistant surface 112 is mounted on an adjacent wall, also not shown. A wood burning stove 113 is shown in phantom lines in FIG. 5 including a pedestal 114 and a flume 115 operatively connected thereto to draw off the smoke. The pedestal 114 is mounted on the horizontal heat resistance surface 111. The stove 113 has doors 116 which can be opened to gain access to the fire box or compartment of the stove.

Barrier 110 has a pair of vertical mounting members 120 which are individually mounted in spaced substantially parallel relation on the horizontal heat resistant surface 111 in upstanding relation by mounting brackets 121 including screws 122 which are extended through the bracket into the horizontal heat resistant surface 111 and into each mounting member 120. Each of the mounting members has four exterior surfaces 123 and extend upwardly to a height such as may be preferred based upon the height of the stove of 113 and the size of the children to be protected. Similarly, the mounting members are spaced from each other a distance such as preferably to define a rectangle of a size in relation to the stove as can best be judged by reference to FIG. 5.

Barrier 110 has a protective panel generally indicated by the numeral 140. The protective panel is composed of a first section 141 which interconnects the mounting members 120 and second sections 142 individually interconnecting each mounting member and the vertical heat resistant surface 112. The first section of the protective panel has an upper edge 143, a lower edge 144 and opposite lateral edges 145. The first section has a forward surface 146 and an opposite rearward surface 147. The first section is composed, as can best be visualized in FIG. 5, of a pair of door portions 148. Each door portion is bounded laterally by a pair of spaced, substantially parallel mounting plates 149 which can be of metal or other suitable material.

Preferably, although not necessarily, each door portion 148 of the first section 141 is composed of three transparent strips or members 150 mounted on and interconnecting the mounting plates 149 thereof in spaced, substantially parallel relation to define air passages 151 between adjoining transparent members 150. As in the case of barrier 10, the transparent members 150 are preferably constructed of a heat resistant plastic material such as plexiglass. Each door portion 148 is mounted on one of the mounting members 120 by a pair of hinge assemblies 152 interconnecting the front exterior surface 123 of its respective mounting member and the mounting plate 149. Hinge assemblies mount each door portion of the first section for pivotal movement between a closed position 153 shown in full lines in FIG. 5 and an opened position to provide full access to the doors 116 of the stove 113. The door portions are shown in partially opened positions 154 in phantom lines in FIG. 5. A suitable latch or other mechanism, not shown, can be employed for locking the door portions in the closed position if so desired.

Each of the second sections 142 has an upper edge 162 and an opposite lower edge 163. Each of the second sections has a proximal lateral edge 165 mounted on its respective mounting member 120 and a distal lateral edge 166 mounted on the vertical heat resistant surface 112. Thus, the first section 141, second sections 142 and vertical heat resistant surface 112 define a rectangular box enclosing and spaced from the stove 113, pedestal 114 and flume 115.

Each second section 142 has a forward surface 167 facing away from the stove 113 and an opposite rearward surface 168 facing toward the stove. Each of the second sections has a pair of mounting plates 169 extending along the proximal lateral edge 165 and the distal lateral edge 166. As with the first section 141, each second section is preferably, although not necessarily, composed of three transparent strips or members 170 mounted on and interconnecting the mounting plates 169 thereof in spaced, substantially parallel relation to define air passages 171 between adjoining transparent members. The transparent members 170 are preferably constructed of heat resistance plastic such as plexiglass. Each second section is mounted on its respective mounting member 120 and the surface of the vertical heat resistant surface 112 by mounting brackets 172 and screws 173.

As previously noted, the barrier of the present invention can be constructed in a wide variety of forms depending upon the particular appliance with which it is to cooperate and the particular needs of the operative environment. The barriers 10 and 110 are simply intended to be illustrative of two such embodiments and the invention hereof is not to be limited thereto. For example, in the case of a cooking range 11 which is installed as a "stand alone" appliance where there are to be no adjoining counters, the second sections 42 thereof can extend rearwardly at right angles to the first section 41 along the sides of the cooking surface 15 so as fully to enclose the cooking surface along the front and sides thereof from access by small children.

Operation

The operation of the described embodiments of the present invention is believed to be readily apparent and is briefly summarized at this point. As previously noted, the barriers 10 and 110 are installed in a manner suiting the particular operative environments there involved.

Thus, the operation thereof varies somewhat based on the differences in the appliances that are employed.

In the case of barrier 10, installation is accomplished by simply adjusting the securing members 93 of the clamp assemblies 85 using the handles 95 thereof to move the swivel feet 96 thereof away from the base portions 88 of the frames 86. This is accomplished to the extent that the distance between the lower protective panel 105 and the swivel feet 96 is greater than the greatest distance between the upper surface 21 and the lower surface 23 of the projecting portion 20 of the cooking range 11. The clamp assemblies are then slipped about the projecting portion 20 and into the position shown in FIG. 2 wherein the lower protective panel 105 abuts the front surface 18 of the cooking range and the swivel feet 96 of the clamp assemblies 85 are above the upper surface 21 of the projecting portion. The handles 95 are thereafter employed to rotate the screw threaded shafts 94 thereof to tighten the swivel feet into binding engagement with the upper surface 21 of the projecting portion. Thus, the clamp assemblies are employed firmly to secure the barrier 10 the position shown in FIGS. 1, 2 and 3. As can best be visualized in FIG. 1, the recessed portion 64 of the lower edges 63 of the second sections 42 thus are disposed in substantially fitted relation to the upper and front surfaces 13 and 14, respectively of the counters 12 so that small children cannot reach beneath the barrier or around the barrier. Furthermore, as can best be seen in FIG. 2 and 3, an air passage is defined between the front section 41 and the lower protective panel 105 permitting air movement in cooling relation to the protective panel 40 and lower protective panel 105 as well as assisting in dissipating residual heat from area proscribed thereby. Similarly, the divergence of the second sections 42 from the cooking surface 15 establishes a protected zone coincident therewith while allowing residual heat to be dissipated therefrom. Still further, the cooking surface remains fully accessible to an adult for purposes of using the cooking range without risk of injury to small children.

The barrier 110 shown in FIG. 5 operates in a manner similar to that described for barrier 10, but provides benefits associated with the use of the stove 113. The door portions 148 can be opened to gain access to the doors 116 as required to operate the wood burning stove 113. Once this has been accomplished, the door portions can be closed and latched and locked by a suitable latch assembly, not shown, to enclose the protected zone defined by the barrier 110 and the vertical heat resistant surface 112. The distance between the lower edges 163 of the second sections 142 and the lower edge 144 of the first section 141 on the one hand and the horizontal heat resistant surface 111 is not great enough for small children to reach therebeneath. Similarly, the upper edge 143 of the first section and the upper edges 162 of the second sections are sufficiently high that small children cannot reach thereover. Still further, the air passages 151 and 171 are sufficiently narrow that small children cannot reach therethrough. Thus, the barrier 110 serves the same function as the barrier 10 in keeping small children from the protected zone defined thereby.

However, in the case of the barrier 110, the air passages 151 and 171, the space between the barrier and the horizontal heat resistant surface 111 and the space defined by the upper edges 143 and 162 of the first and second sections respectively permit heat to be transmitted therethrough to the surrounding room without any interference whatsoever by the barrier 110. Similarly, since the protective panel 140 is substantially transparent, the aesthetic appeal of the stove 113, pedestal 114 and flume 115 achieve their full effect without interference from the barrier. Still further, the fact that the transparent members 150 and 170 are heat resistant and the release of the heat through the air passages previously described, prevents a risk of fire and reduces the temperature of the structure of the barrier to the extent that it does not itself constitute a hazard to small children.

Therefore, the barrier for appliances and the like of the present invention possesses a flexibility of use having application to virtually all types of such appliances and the like where such hazards are present; is adapted securely to be attached to a position on or near the appliances without complex or permanent damage to the appliances; operates to insulate itself from becoming heated to a degree which would be injurious in contact therewith; in the case of appliances such as cooking ranges, operates to dissipate unwanted heat; and in the case of heating devices such as stoves, operates to permit the transmission of the heat therethrough to adjacent areas for warmth.

Although the invention has been herein shown and described in what are conceived to be the most practical and preferred embodiments, it is recognized that departures may be made therefrom within the scope of the invention which is not to be limited to the illustrative details disclosed.

Having described my invention, what I claim as new and desire to secure by Letters Patent is:

1. A barrier for an appliance such as a cooking range or the like having a heat generating zone, a front marginal edge and a portion projecting forwardly from said front marginal edge, the barrier comprising:

a plurality of clamps each having a frame, with substantially flat back portion, a base portion and a mounting portion and a securing member, having a foot portion, screw-threadably mounted in and extending through the mounting portion for screw threaded adjustment to move the foot portion thereof toward and from the base portion of the frame for clamping engagement with said projecting portion of the appliance in an installed position; and a substantially transparent panel mounted on the back portions of the frames of said clamps and having a first section which in said installed position is disposed in spaced substantially parallel relation to said front marginal edge of the appliance and extends upwardly therefrom and a pair of second sections extending laterally of said first section on opposite sides thereof and extending in diverging relation rearwardly and outwardly from said front marginal edge to proscribe a protected zone coincident with said heat generating zone.

2. The barrier of claim 1 including a second panel mounted on and interconnecting the base portions of the frames of said clamps to form a lower boundary to said protected zone.

3. The barrier of claim 2 wherein said second panel is spaced from the first panel to define a path of air movement into said protected zone in heat dissipating relation to said panels.

4. The barrier of claim 1 wherein said second sections of the panel have lower edges configured to fit about adjacent structures in juxtaposition thereto.

* * * * *